US006128837A

United States Patent [19]

Huang

[11] Patent Number: 6,128,837

[45] **Date of Patent: *Oct. 10, 2000**

[54] THREE DIMENSIONAL SHOE VAMP AIR CUSHION

[76] Inventor: Ing Jing Huang, No. 218 Cheng Kong, 3rd Road, Nantou City, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/874,452

[22] Filed: Jun. 16, 1997

[30] Foreign Application Priority Data

Jun. 15, 1996 [TW] Taiwan ..... 85107200

[51] Int. Cl.[7] ..... A43B 23/26

[52] U.S. Cl. ..... 36/54; 36/88; 36/93

[58] Field of Search ..... 36/88, 93, 54

[56] References Cited

U.S. PATENT DOCUMENTS

| | | | |
|---|---|---|---|
| 1,193,608 | 8/1916 | Poulson . | |
| 1,382,831 | 6/1921 | Hilker . | |
| 2,028,060 | 1/1936 | Gilbert . | |
| 2,074,286 | 3/1937 | Sullivan . | |
| 2,372,218 | 3/1945 | Manson et al. . | |
| 2,465,268 | 3/1949 | Rogers et al. . | |
| 2,677,906 | 5/1954 | Reed . | |
| 2,762,134 | 9/1956 | Town . | |
| 2,874,826 | 2/1959 | Matthews et al. . | |
| 3,344,684 | 10/1967 | Steere, Jr. et al. . | |
| 3,765,422 | 10/1973 | Smith . | |
| 3,795,994 | 3/1974 | Ava . | |
| 3,991,420 | 11/1976 | Savarino . | |
| 4,054,960 | 10/1977 | Pettit et al. . | |
| 4,115,885 | 9/1978 | Davis . | |
| 4,217,705 | 8/1980 | Donzis . | |
| 4,232,459 | 11/1980 | Vaccari | 36/71 |
| 4,387,516 | 6/1983 | Laux . | |
| 4,422,194 | 12/1983 | Viesturs et al. . | |
| 4,517,693 | 5/1985 | Viesturs . | |
| 4,541,136 | 9/1985 | Graebe . | |
| 4,614,000 | 9/1986 | Mayer . | |
| 4,629,433 | 12/1986 | Magid . | |
| 4,670,995 | 6/1987 | Huang . | |
| 4,845,861 | 7/1989 | Moumdjian . | |
| 5,158,767 | 10/1992 | Cohen et al. | 36/93 X |
| 5,193,246 | 3/1993 | Huang . | |
| 5,195,257 | 3/1993 | Holcomb et al. | 36/28 |
| 5,444,926 | 8/1995 | Allen et al. | 36/54 X |
| 5,701,688 | 12/1997 | Crowley | 36/54 X |

FOREIGN PATENT DOCUMENTS

| | | |
|---|---|---|
| 540 623 | 7/1922 | Belgium . |
| 645 151 | 3/1964 | Belgium . |
| 1240066 | 7/1960 | France . |
| 2573988 | 6/1986 | France . |
| 807010 | 6/1951 | Germany . |
| 31 16 499 | 11/1982 | Germany . |
| 2050145 | 1/1981 | United Kingdom . |
| 2085278 | 1/1982 | United Kingdom . |

*Primary Examiner*—Paul T. Sewell
*Assistant Examiner*—Jila Mohandesi
*Attorney, Agent, or Firm*—Jacobson, Price, Holman & Stern, PLLC

[57] ABSTRACT

A three dimensional shoe vamp air cushion having an upper sheet and a lower sheet, with all peripheral edges sealed to form a hollow interior. An upper area of the air cushion is larger than the interior area, permitting the air cushion body to have three dimensions instead of two dimensions. The three dimensional shoe vamp air cushion has one or more air chambers and a similar curvature as the upper surface of a foot, so as to have excellent adaptability and shock absorbing characteristics.

11 Claims, 4 Drawing Sheets

THREE DIMENSIONAL SHOE VAMP AIR CUSHION

BACKGROUND OF THE INVENTION

This invention concerns a 3D shoe vamp air cushion, particularly having a 3D structure to give eccellent shock-absorbing effect and a similar curvature to fit on an upper surface of a foot.

A conventional shoe vamp is usually provided with a sponge or foam rubber so as to reduce pressure of a shoe string against an upper surface of a foot. However, its thickness is limited, and so is its elasticity, which may be gradually lost by use for a long period of time.

SUMMARY OF THE INVENTION

This invention has been devised to offer a 3D shoe vamp air cushion having an excellent shock-absorbing effect.

A main feature of the invention is an upper sheet and a lower sheet sealed together at peripheral edges to form a 3D hollow interior and one or more air chambers to fill with a gas or the like. Further, the upper sheet and/or the lower sheet can be formed with a plurality of recessed lines or recessed holes. Besides, an air valve can also be attached with the air cushion for inflating it.

BRIEF DESCRIPTION OF DRAWINGS

This invention will be better understood by referring to the accompanying drawings, wherein.

DETAILED DESCRIPTION OF THE PREFERRED EMBODIMENTS

A first preferred embodiment, a second preferred embodiment and a third preferred embodiment of a 3D shoe vamp air cushion 1 in the present invention all commonly have a 3D hollow structure, of any elevational shape. They can have recessed lines or recessed holes 3 or can have no such lines 2 or holes 3 in an upper sheet and/or a lower sheet, as a shoe vamp air cushion itself has low inner pressure.

Figure 1:
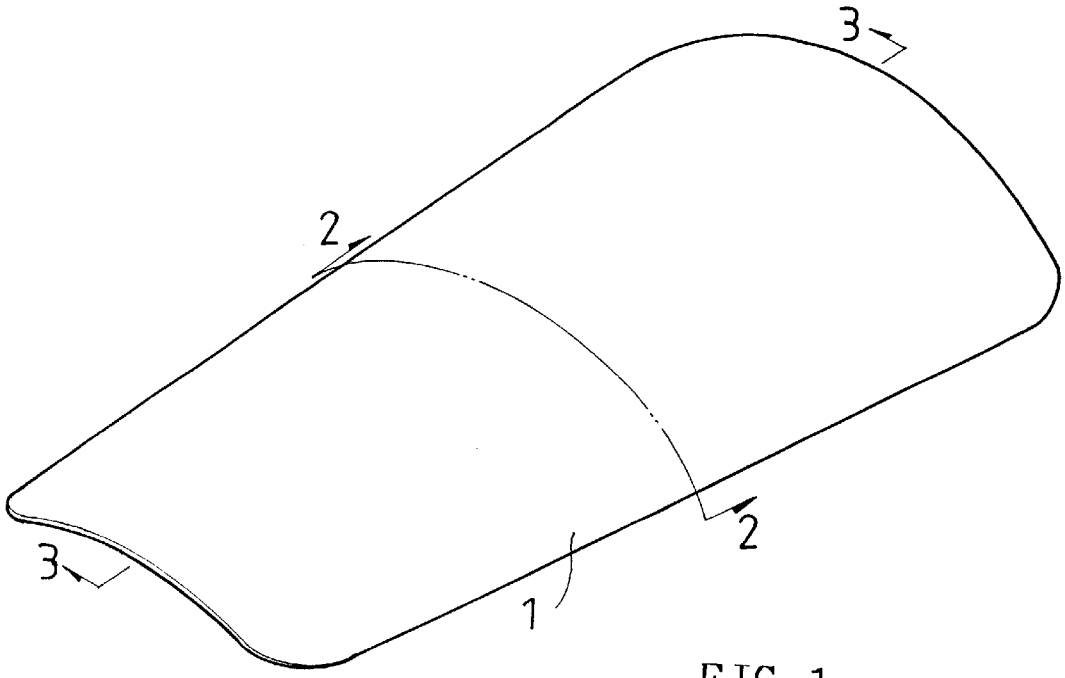
FIG. 1 is a perspective view of a first preferred embodiment of a shoe vamp air cushion in the present invention.
Figure 3:
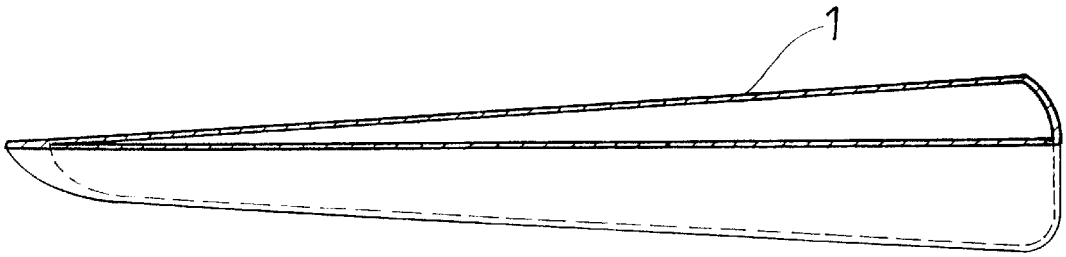
FIG. 3 is a cross-sectional view of line 3—3 in FIG. 1.
Figure 2:
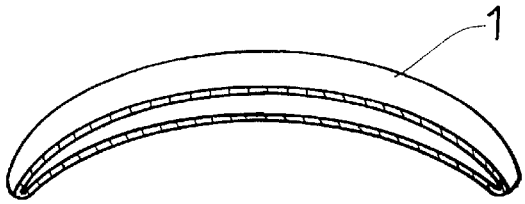
FIG. 2 is a cross-sectional view of line 2—2 in FIG. 1.

The first preferred embodiment of a shoe vamp air cushion 1 in the invention, as shown in FIGS. 1–3, has an upper sheet and a lower sheet sealed at all peripheral edges to for a 3D hollow interior so that an upper area of the shoe vamp air cushion 1 is larger than the inner hollow area. The upper and the lower sheet are curved inward to form a cross-section of curved lines. A hollow passageway 10 can be additionally provided in the shoe vamp air cushion 1 for attaching an air valve or an air pump for inflating the air cushion 1. Of course, this hollow passageway can be omitted, permitting the air cushion 1 formed to be sealed.

Figure 4:
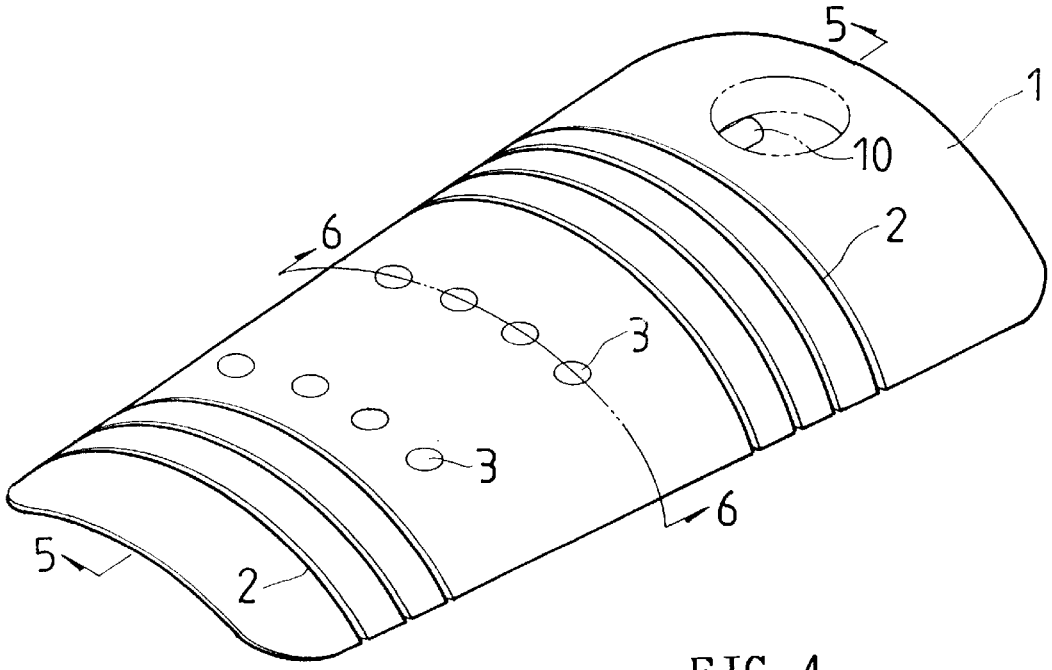
FIG. 4 is a perspective view of a second preferred embodiment of a shoe vamp air cushion in the present invention.
Figure 5:
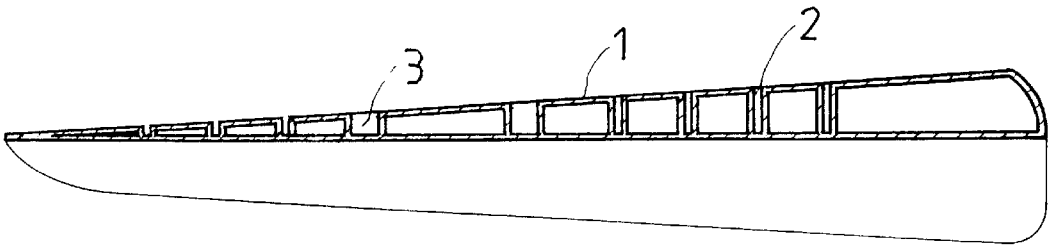
FIG. 5 is across-sectional view of line 5—5 in FIG. 4.
Figure 6:
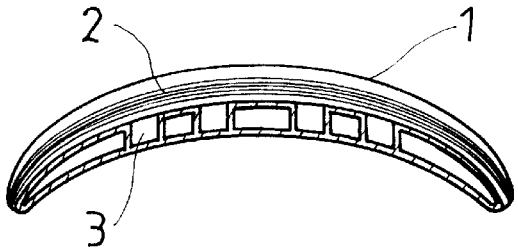
FIG. 6 is a cross-sectional view of line 6—6 in FIG. 4.

FIGS. 4–6 show a second preferred embodiment of a 3D shoe vamp air cushion 1, having an upper sheet and a lower sheet and all circumferential edges are sealed to form a 3D hollow interior. The upper area of the shoe vamp air cushion 1 is larger than the inner hollow area. Further, the upper sheet and the lower sheet are curved inward to form a cross-sectional of curved lines. Further, the upper sheet and/or the lower sheet are provided with a plurality of recessed lines 2 or recessed holes 3, which have not only memory capacity of supporting the air cushion 1 with three dimensions but also flexibility to bend sidewise. In addition, the shoe vamp air cushion 1 has a curvature extending to two sides in such a way that it can just fit on a curved upper surface of a foot. Besides, a hollow passageway 10 may be additionally provided in the air cushion 1 for attaching an air valve or an air pump for inflating it. Of course, the hollow passageway 10 can be omitted.

Figure 7:
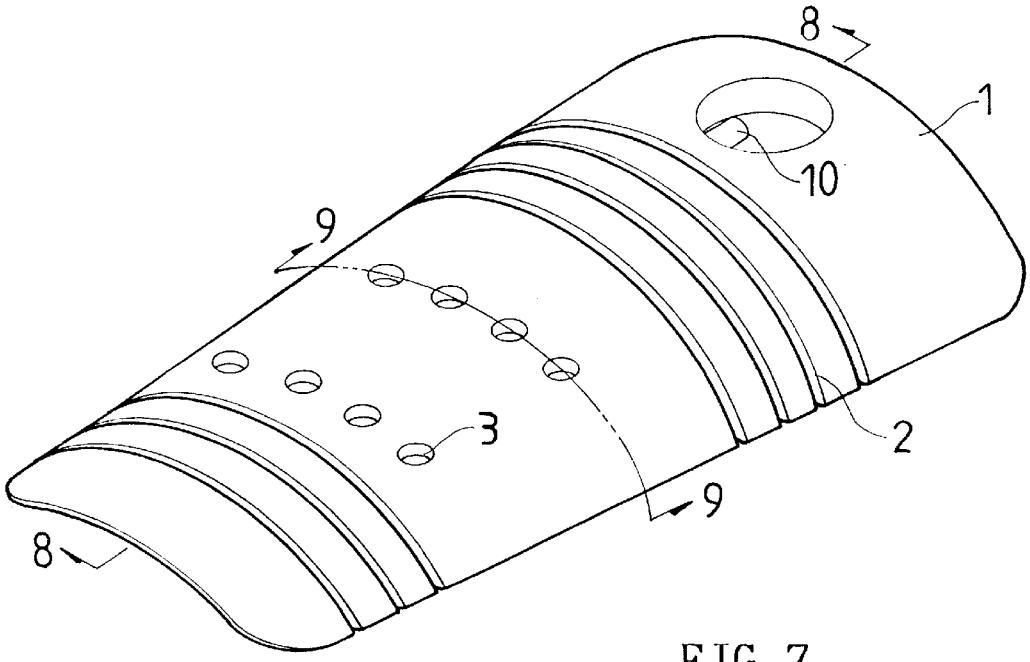
FIG. 7 is a perspective view of a third preferred embodiment of a shoe vamp air cushion in the present invention.
Figure 8:
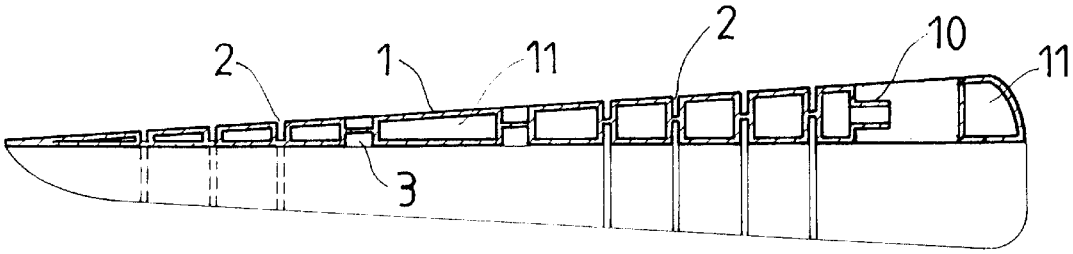
FIG. 8 is a cross-sectional view of line 8—8 in FIG. 7.
Figure 9:
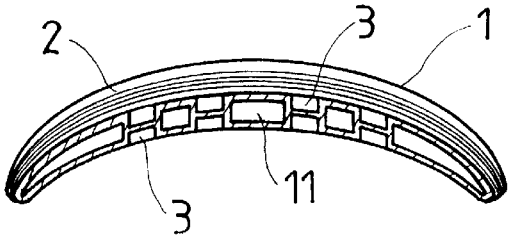
FIG. 9 is a cross-sectional view of line 9—9 in FIG. 7.

FIGS. 7–9 show a third preferred embodiment of a shoe vamp air cushion, which also has an upper sheet and a lower sheet and all the peripheral edges are sealed. The upper sheet and/or the lower sheet are(is) provided with a plurality of recessed lines 2 and/or recessed holes 3, which have not only memory capacity of supporting the air cushion 1 with three dimensions but also flexibility to bend sidewise. In addition, the shoe vamp air cushion 1 has a curvature extending to two sides in such a way that it can just fit on a curved upper surface of a foot. Further, a plurality of air chambers 11 are formed in this shoe vamp air cushion 1, extending to two sides in accordance with the 3D hollow shape of the air cushion 1. A hollow passageway 10 can be additionally provided in this shoe vamp air cushion 1, but can be omitted.

The shoe vamp air cushion 1 in the invention has a structure of a curved 3D hollow shape, and a curvature to suit to that of an upper surface and two sides of a foot, with the air chambers 11 formed therein also extending in the same way as the curvature to rest on the upper surface and the two sides of a foot, producing good shock-absorbing function for a large area.

If the shoe vamp air cushion 1 is compressed or receives a shock, the air contained therein disperses to two sides evenly, in other words, shock force disperses to two sides, and dispersing air pressure is concentrated on the two sides of the air cushion 1, producing effect of clamping the upper surface of a foot with the two sides. When shock force disappears, air pressure at once moves back to the center portion from the two sides thereof, forming automatic bouncing-back elasticity. So the shoe vamp air cushion in the present invention not only has good effect of shock-absorbing, secure stability, excellent elasticity, comfortableness and adaptability.

Figure 10:
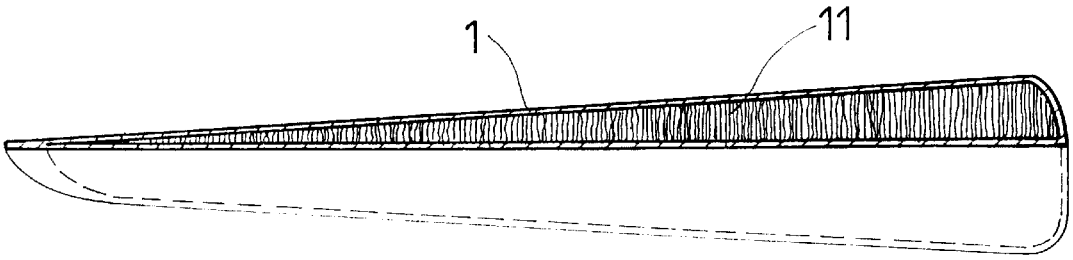
FIG. 10 a cross-sectional view of the first shoe vamp air cushion in FIG. 2 filled with a layer of fiber in the present invention.
Figure 11:
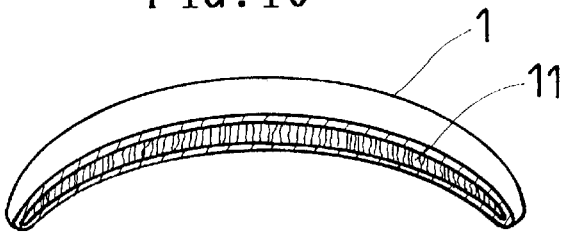
FIG. 11 is a cross-sectional view of the first shoe vamp air cushion in FIG. 3 filled with a layer of fiber in the present invention; and, FIG. 12 a cross-sectional view of the first shoe vamp air cushion filled with a layer of foam material in the present invention.
Figure 12:
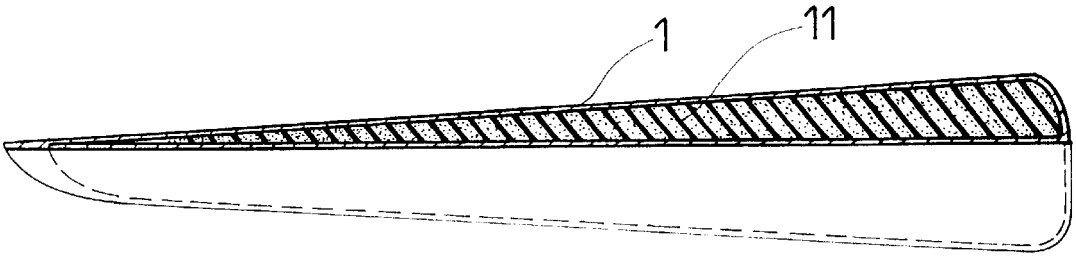

In the interior of the shoe vamp air cushion 1 can be filled a gas, but foam material, powder material, fiber, liquid, semi-liquid, low-percolating large particle gas such as SF6, C2F6, etc. can also be used instead of a gas. Besides, if the shoe vamp air cushion 1 is not provided with recessed lines 2 or recessed holes 3, a layer of fiber or foam can be added between the upper sheet and the lower sheet as shown in FIGS. 10–12, with an uneven thickness.

As can be understood from the above description, this 3D shoe vamp air cushion not only has excellent shock-absorbing effect but a similar curvature as an upper surface of a foot to be worn with comfort.

While the preferred embodiments of the invention have been described above, it will be recognized and understood that various modifications may be made therein and the appended claims are intended to cover all such modifications which may fall within the spirit and scope of the invention.

What is claimed is:

1. A three dimensional shoe vamp air cushion comprising a curved upper sheet and a curved lower sheet, a hollow interior formed between sealed peripheral edges of said lower sheet and said upper sheet, said hollow interior being defined between two opposed side edges and two opposed ends, said sheets each having lengthwise surfaces shaped so as to be both curving inwardly, and said upper sheet and said lower sheet being continuously smooth surfaces between said side edges and said two opposed ends, each having cross-sections of curved lines, a surface area of said upper sheet being larger than a surface area of said lower sheet.

2. The three dimensional shoe vamp air cushion as claimed in claim 1, wherein said air cushion is provided with a hollow passageway for attachment to one of an air valve or an air pump communicating with ambient air for inflating said air cushion.

3. The three dimensional shoe vamp air cushion as claimed in claim 1, wherein a layer of soft material disposed between said upper sheet and said lower sheet is selected from the group consisting of fiber and foam.

4. A three dimensional shoe vamp air cushion comprising an upper sheet and a lower sheet having all peripheral edges sealed to form a hollow interior and including longitudinally extending peripheral side edges, said sheets forming two lengthwise surfaces extending to form a curved inward air cushion, and said upper sheet and said lower sheet each having cross-sections of curved lines, a plurality of recessed depressions extending inwardly from at least one of the upper sheet and the lower sheet, the recessed depressions extending widthwise entirely across the air cushion until reaching the longitudinally extending peripheral side edges.

5. The three dimensional shoe vamp air cushion as claimed in claim 4, wherein said air cushion is provided with a hollow passageway for attachment to one of an air valve or an air pump communicating with ambient air for inflating said air cushion.

6. A three dimensional shoe vamp air cushion comprising an upper sheet and a lower sheet having a hollow interior therebetween and including longitudinally extending peripheral side edges, said sheets forming two lengthwise surfaces extending in the form of an inward curved air cushion, said upper sheet and said lower sheet each having cross-sections of curved lines, and at least one of said upper sheet and said lower sheet being provided with a plurality of depressions selected from the group consisting of recessed lines and recessed holes, the recessed lines extending inwardly from at least one of the upper sheet and the lower sheet, the recessed lines extending widthwise entirely across the air cushion until reaching the longitudinally extending peripheral side edges, the recessed holes extending inwardly from at least one of the upper sheet and the lower sheet, the recessed holes defining cylindrical shaped depressions.

7. The three dimensional shoe vamp air cushion as claimed in claim 6, wherein said air cushion is provided with a hollow passageway for attachment to one of an air valve or an air pump communicating with ambient air for inflating said air cushion.

8. A three dimensional shoe vamp air cushion comprising an upper sheet and a lower sheet, a layer of soft material located in a hollow interior formed between said upper sheet and said lower sheet and attached between said sheets, said sheets each having lengthwise surfaces shaped so as to be curving inwardly, and said upper sheet and said lower sheet each having cross-sections of curved lines, at least one of said upper sheet and said lower sheet being provided with a plurality of depressions selected from the group consisting of recessed lines and recessed holes, the recessed lines extending inwardly from at least one of the upper sheet and the lower sheet, the recessed lines extending widthwise entirely across the air cushion until reaching longitudinally extending peripheral side edges, the recessed holes extending inwardly from at least one of the upper sheet and the lower sheet, the recessed holes defining cylindrical shaped depressions.

9. The three dimensional shoe vamp air cushion as claimed in claim 8, wherein said air cushion is provided with a hollow passageway for attachment to one of an air valve or an air pump communicating with ambient air for inflating said air cushion.

10. A three dimensional shoe vamp air cushion comprising an upper sheet and a lower sheet having a hollow interior therebetween, an upper area of said upper sheet being larger than an inner hollow area of said lower sheet, said sheets forming two lengthwise surfaces extending in the form of an inward curved air cushion, said upper sheet and said lower sheet each having cross-sections of curved lines, and at least one of said upper sheet and said lower sheet being provided with a plurality of depressions selected from the group consisting of recessed lines and recessed holes, the recessed lines extending inwardly from at least one of the upper sheet and the lower sheet, the recessed lines extending widthwise entirely across the air cushion until reaching longitudinally extending peripheral side edges, the recessed holes extending inwardly from at least one of the upper sheet and the lower sheet, the recessed holes defining cylindrical shaped depressions.

11. The three dimensional shoe vamp air cushion as claimed in claim 10, wherein said air cushion is provided with a hollow passageway for attachment to one of an air valve or an air pump communicating with ambient air for inflating said air cushion.

* * * * *